United States Patent [19]

Howard et al.

[11] 4,002,000

[45] Jan. 11, 1977

[54] BEAM CONSTRUCTION AND METHOD OF MANUFACTURE

[75] Inventors: Robert W. Howard, Stouffville; Desmond K. Rose, Mississauga, both of Canada

[73] Assignee: Palmer-Shile Company, Detroit, Mich.

[22] Filed: June 30, 1975

[21] Appl. No.: 591,868

[52] U.S. Cl. ..... 52/729; 52/224; 52/731

[51] Int. Cl.[2] ..... E04C 3/30; E04C 3/10

[58] Field of Search ..... 52/731, 732, 729, 224, 52/223, 758 B

[56] References Cited

UNITED STATES PATENTS

| | | | |
|---|---|---|---|
| 426,558 | 4/1890 | Dithridge | 52/729 |
| 1,360,720 | 11/1920 | Brown et al. | 52/729 |
| 1,959,135 | 5/1934 | Miller | 52/729 |
| 2,508,032 | 5/1950 | Kennedy | 52/729 |
| 3,088,749 | 5/1963 | Schilberg | 52/758 B |
| 3,332,197 | 7/1967 | Hinkle | 52/732 |
| 3,517,474 | 6/1970 | Lanternier | 52/732 |
| 3,753,326 | 8/1973 | Kaufman, Sr. | 52/732 |

*Primary Examiner*—Price C. Faw, Jr.
*Assistant Examiner*—Robert C. Farber
*Attorney, Agent, or Firm*—Harness, Dickey & Pierce

[57] ABSTRACT

Two relatively thin sheets of metal are placed in stacked relation and bent so as to form two nested members, each having a pair of spaced parallel flanges, a central web portion at right angles to the flanges, and two inclined web portions connecting the central web portion with the flanges. The inner formed plate is then removed from the outer plate, reversed, and its flanges inserted within the flanges of the outer plate. The beam sections are then secured together.

2 Claims, 4 Drawing Figures

BEAM CONSTRUCTION AND METHOD OF MANUFACTURE

BACKGROUND OF THE INVENTION

1. Field of the Invention

This invention relates to beam constructions and the method of manufacture of beams, particularly those used for industrial storage racks, such as pallet racks, and similar purposes.

2. Description of the Prior Art

An adjustable storage rack and beam constructions therefor are shown in Kimpton U.S. Pat. No. 3,194,408 issued July 13, 1965. In this patent the beam has spaced parallel flanges, a central web portion perpendicular to and between the flanges, and inclined web portions connecting the central web portion with the flanges.

The illustrated embodiment of the present invention discloses this basic construction in a double form, that is, with two such beams in facing and interfitting relation. It is known to form beams, for example, of channel-shaped construction with identical dimensions, and overlap the flanges of such beams to form a closed box. The channel members are then secured together. A disadvantage of such constructions is that it is often difficult to obtain a good fit, with both sets of flanges in good contact. Lack of a proper fit could detract from the load capacity of the beam.

Another disadvantage of conventional closed beam construction used in industrial storage environments if the vulnerability of the beam edges to denting and other abuse from impact, for example, caused by a forklift truck.

It is an object of the present invention to overcome some of the disadvantages of the previous beam constructions used for industrial storage purposes, and to provide a novel and improved beam construction, and method of manufacture, which reduces the weight requirements for a given load capacity.

It is another object to provide an improved beam construction and method of manufacture which is highly resistant to horizontal impact forces such as might be incurred by moving vehicles in a storage area.

It is another object to provide an improved method of constructing beams which insures the formation of a closed type of beam with a relatively good fit between the beam sections, thereby enhancing the load capacity.

It is also an object to provide an improved beam construction of this nature which offers a convenient surface on the aisle side of the beam for affixing labels or other markings which will not be easily brushed off.

Briefly, the beam construction of this invention comprises first and second beam sections, each section comprising a pair of spaced parallel flanges, a central web portion between and at right angles to said flanges and spaced therefrom, and first and second inclined web portions connecting the edges of the central web portion to the edges of the flanges on the same side thereof, the outer surfaces of the flanges of said second beam section fitting snugly within the inner surfaces of the flanges on the first beam section, whereby the sections together form a closed beam, and means securing said beam sections together.

The method of the present invention comprises a method of constructing a closed beam comprising the steps of placing two elongated flat metal plates having the same width in stacked relation, simultaneously bending said plates so as to form two nested beam sections with each section having a pair of spaced parallel flanges, a central web portion between and at right angles to said flanges and spaced therefrom, and first and second inclined web portions connecting the edges of said central web portion to edges of said flanges on the same sides thereof, removing the inner beam section from the outer section, reversing the inner section with respect to the outer section, slipping the flanges of the inner section between the flanges of the outer section until they overlap to a substantial extent, and securing said sections together.

DESCRIPTION OF THE PREFERRED EMBODIMENTS

Figure 1:
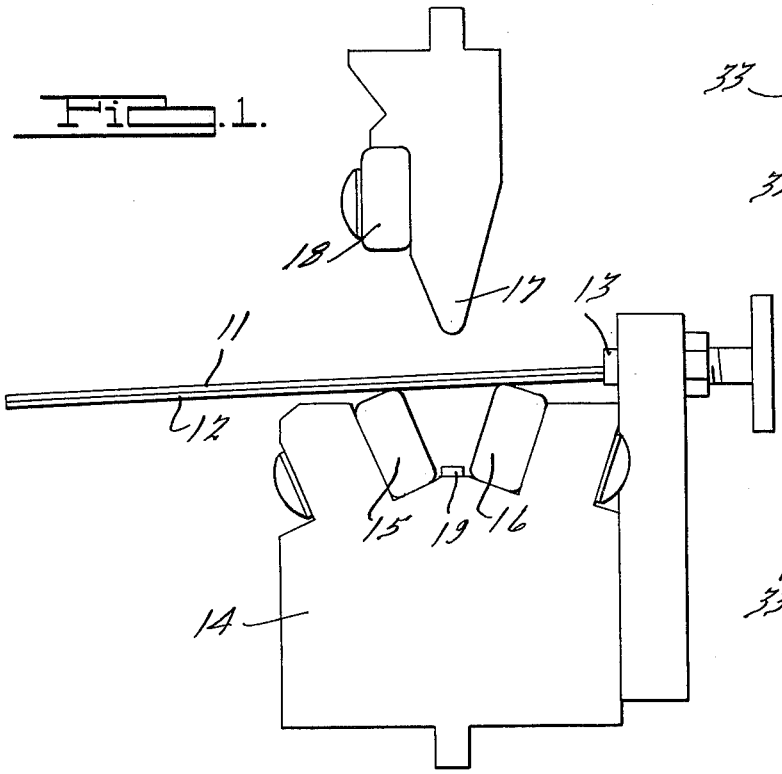
FIG. 1 shows a preliminary step in the method of manufacturing a beam of this invention.
Figure 2:
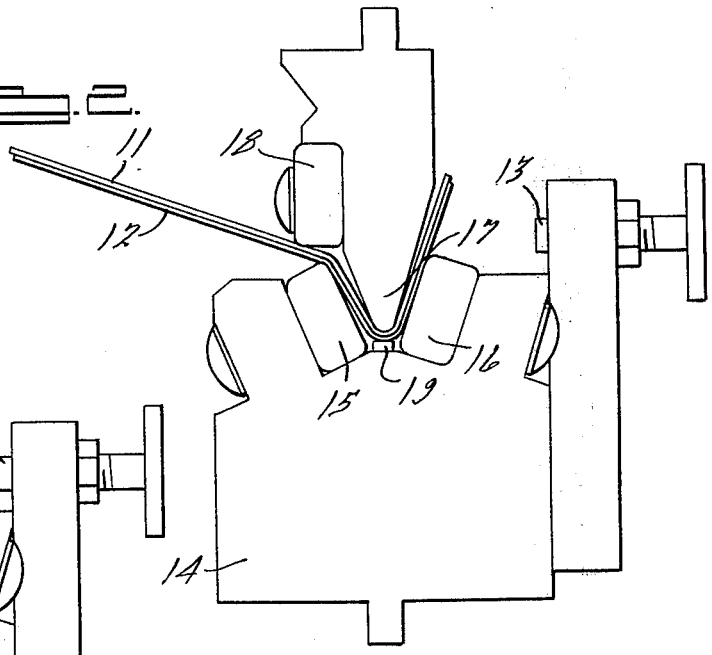
FIG. 2 shows a subsequent step.

As shown in FIG. 1, two relatively thin elongated flat metal plates 11 and 12, having the same width, are placed in stacked relation. They are positioned so as to engage an adjustable stop 13 carried by a lower die 14 having wear plates 15 and 16. These wear plates have rounded edges and are so positioned as to form an upwardly open V, and a complementary V-shaped upper die 17 with a rounded lower edge and carrying a wear plate 18 on one side, descends between wear plates 15 and 16. This forces plates 11 and 12 downwardly against a stop 19 disposed between the lower ends of wear plates 15 and 16 (FIG. 2). One flange as well as one of the inclined web portions has now been formed on each plate 11 and 12.

The upper die is then raised and plates 11 and 12 reversed so that their opposite edges abut stop 13. The die then descends a second time (FIG. 3) forming the other flanges and inclined web portions.

Figure 4:
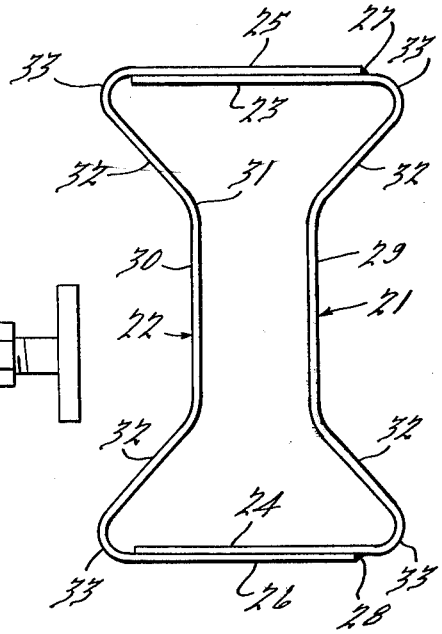
FIG. 4 shows the finished beam.
Figure 3:
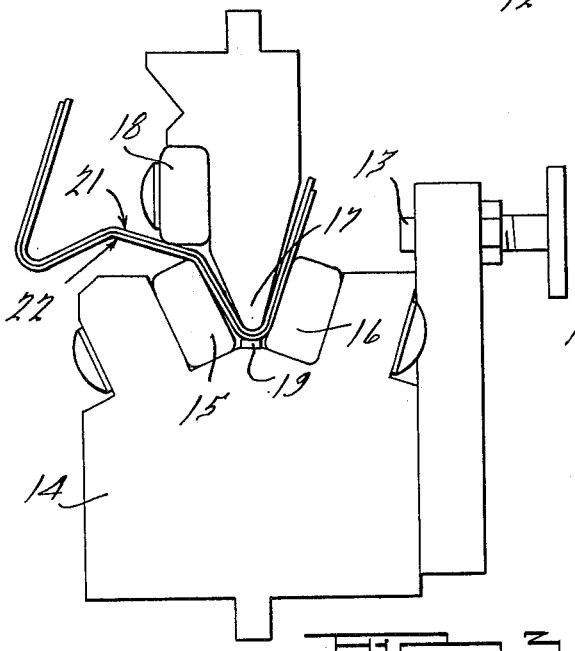
FIG. 3 shows a later step.

The formed plates are then removed from the dies and the inner beam section, generally indicated at 21 in FIG. 3, is removed from the outer section generally indicated at 22. The two flanges 23 and 24 of the inner section are inserted between the flanges 25 and 26 of the outer section (FIG. 4). Preferably, the dimensions of the parts are such that there will be substantially full overlapping between the flanges. Because of the fact that the two sections 21 and 22 were formed simultaneously and in conjunction with each other, a good snug fit between the flanges is assured so that the beam sections will deflect together under load. The outer edges of flanges 25 and 26 are welded to flanges 23 and 24, as indicated at 27 and 28 respectively.

The finished beam will have a space between the central web portions 29 and 30 of beam sections 21 and 22 respectively. The junctures 31 between inclined web portions 32 of the beam sections and central web portions 29 and 30 are rounded, as are the junctures 33 which form corners between the inclined web portions and the spaced parallel flanges. Corners 33 will be resistant to horizontal impact damage from forklift trucks or other moving vehicles. The recesses formed by the inclined web portions for central web portions 29 and 30 provide convenient surfaces for affixing labels that will not be easily brushed off on the aisle side of the beam.

The strength properties of the novel beam of this invention is enhanced by its closed nature which imparts greater resistance to lateral buckling and thus permits the use of thinner gauge metals for a given load capacity. The fact that the upper and lower portions of the beam are of double thickness also enhances the strength. Since the flanges overlap substantially completely, maximum surface area is available for supporting pallets or other loads.

An example of weight saving for the novel beam is seen by comparing it with the required weight for a beam of the type shown in the aforementioned U.S. Pat. No. 3,194,408. For the latter beam having a span of 108 inches and a capacity of 4,000 pounds, the weight of one pair of beams (front and back beams for a storage rack) is 79 pounds. For a pair of beams made in accordance with the present invention, with the same span, for 4,809 pounds capacity, the required weight is 61 pounds.

As another example, for a 138 inch span, a pair of beams made in accordance with the aforementioned patent and having a capacity of 6,000 pounds would weigh 158 pounds. If made in accordance with the present invention, a pair of beams for the same span and having a capacity of 6,760 pounds would only weigh 98 pounds.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

We claim:

1. In a beam for use in industrial storage racks or the like, first and second beam sections, each section comprising a pair of spaced parallel flanges, said flanges being flat throughout their widths, a central web portion between and at right angles to said flanges and spaced therefrom a distance substantially greater than their thickness, and first and second inclined web portions connecting the edges of the central web portion to the edges of the flanges on the same side thereof, the outer surfaces of said second beam section flanges being spaced apart a distance substantially equal to the inner surfaces of said first beam section flanges, the outer surfaces of the flanges of said second beam section fitting snugly within the inner surfaces of the flanges on the first beam section, the flanges of said two beam sections overlapping substantially completely, whereby the sections together form a closed beam, and means securing said beam sections together comprising welds between the outer edges of the first beam section flanges and said second beam section.

2. A beam according to claim 1, the central web portions of said beam sections being spaced apart.

* * * * *